US007310967B2

(12) United States Patent
Aragon

(10) Patent No.: US 7,310,967 B2
(45) Date of Patent: Dec. 25, 2007

(54) TEMPERATURE CONTROLLED CONTAINER

(76) Inventor: Daniel M. Aragon, 1406 W. Chance Ct., Eagle, ID (US) 83616

( * ) Notice: Subject to any disclaimer, the term of this patent is extended or adjusted under 35 U.S.C. 154(b) by 201 days.

(21) Appl. No.: 11/064,254

(22) Filed: Feb. 22, 2005

(65) Prior Publication Data

US 2005/0188715 A1 Sep. 1, 2005

Related U.S. Application Data

(60) Provisional application No. 60/546,242, filed on Feb. 20, 2004.

(51) Int. Cl.
*F25D 3/08* (2006.01)

(52) U.S. Cl. ..... 62/371; 62/457.2

(58) Field of Classification Search ..... 62/371, 62/384, 457.2

See application file for complete search history.

(56) References Cited

U.S. PATENT DOCUMENTS 4,294,079 A 10/1981 Benson
4,377,075 A 3/1983 Russo
4,509,587 A 4/1985 Clark et al.
4,947,658 A 8/1990 Wheeler et al.
5,363,670 A * 11/1994 Bartilucci ..... 62/166
5,598,713 A * 2/1997 Bartilucci ..... 62/78
5,899,088 A 5/1999 Purdum
5,924,302 A 7/1999 Derifield
6,003,322 A 12/1999 Graham
6,044,650 A 4/2000 Cook et al.
6,070,427 A 6/2000 Fine et al.
6,189,330 B1 2/2001 Retallick et al.
6,233,965 B1 5/2001 Choy
6,257,764 B1 7/2001 Lantz
6,789,391 B2 9/2004 Graham et al.

OTHER PUBLICATIONS

Cold Chain Asia, "Olivo—Insulated Roll," www.coldchainasia.com/insulatedroll.html.
Cold Chain Asia, "Olivo-Siber System" www.coldchainasia.com/sibersystem.html.
Cold Chain Asia, "Olivo—Insulated BAC," www.coldchainasia.com/insulatedbac.html.
Envirotainer, "Envirotainer Container Rap," www.envirotainer.com/products/large.asp.

* cited by examiner

*Primary Examiner*—Melvin Jones
(74) *Attorney, Agent, or Firm*—Robert L. Shaver; Dykas, Shaver & Nipper, LLP

(57) ABSTRACT

A cryogenic shipping and storage container, with an on-board cooling unit in the form of a bunker for holding solid refrigerant. The unit can be configured for different sizes, and to refrigerate rather than freeze product.

33 Claims, 6 Drawing Sheets

TEMPERATURE CONTROLLED CONTAINER

PRIORITY

This application claims the priority date of the provisional application entitled SHIPPING CONTAINER filed by Dan Aragon on Feb. 20, 2004 with application Ser. No. 60/546,242.

BACKGROUND OF THE INVENTION

1. Field of the Invention

The invention relates to refrigerated shipping containers, and more particularly to containers for cryogenic cooling.

2. Background Information

There are a number of situations in which a temperature controlled container is useful. One of these is when a manufacturing process utilizes a temperature dependent product. For instance, epoxy is formed from two chemicals that are mixed together. After the chemicals are mixed together there is a short amount of time available before the epoxy sets up into a hard material. In some operations, it is desirable to mix up a large quantity of epoxy, and delay the onset of hardening. This can be accomplished in a container in which the mixed epoxy can be placed, with cooling provided to delay the onset of hardening. With this kind of capability, one area of a plant can mix the epoxy, and it can be shipped in a cooled container to another area of the plant where it is utilized. Also, larger quantities of epoxy can be mixed together, and utilized by taking a desired quantity out of the cooled box. In this way, all of the epoxy used on a project would have the same mixture of the two components and thus, would be more uniform. There are other temperature dependent manufacturing steps which could utilize a temperature controlled box, especially one that could achieve extremely low temperatures at a reasonable cost, and which could operate without external power and could be transported easily.

Another situation in which a temperature controlled container would be useful is in medical use, field hospital use and emergency situation response. In such situations, what is needed is a container which is low-tech, can be built to the capacity required for any tasks, can economically keep materials at a low temperature for a long period of time, and which don't require an electrical connection. Such a container could be utilized in field hospitals in the military, for storing blood plasma, vaccines, and other supplies used in the hospital. It could also be utilized for transporting tissues, organs for transplant and other medical related items. In a disaster area, it could hold vaccines, medicines, blood plasma and other medical materials which need refrigeration or freezing.

Another area in which a temperature controlled container is needed, is in the transport of foods in a frozen or refrigerated state. Certain foods are in high demand in areas that are far from where the food is processed. For such foods, it is highly important that the food arrive at its destination in prime condition. This would be true for high valued foods such as fish products bound for the Japanese or other distant markets, Kobe beef being transported from Japan, caviar being shipped from Russia, and other specialized, high value items.

Another need is in the food service field. A temporary or portable freezer may be needed in a field kitchen, or in a restaurant with a need for a temporary freezer to replace a walk-in freezer that is being repaired or replaced, or if the need arose, to permanently serve as the facility freezer. This would be especially true in a remote location where power may not be available, but weekly shipments of dry ice are available.

The prior art for accomplishing these tasks include an insulated picnic box which typically has a hinged lid and a layer of insulation. The hinged lid is closed by a latch. For certain uses of such a picnic cooler, frozen food is placed inside the cooler, along with ice or dry ice, and the picnic cooler lid is closed and possibly taped shut. Use of such a pack will preserve food for several days, but often when the food is opened it is floating in water from the melted ice, or it is melted because it has thawed. Also, if the lid has to be opened and closed very often, heat is introduced to the food inside and its frozen time and temperature are reduced.

Another prior art system is to use a powered refrigeration system with a shipping container. This can be a motorized device that is powered by a fuel such as gasoline or diesel, and runs a compressor and a refrigeration unit in a conventional way. Such a refrigeration unit has disadvantages, which are that it produces exhaust fumes which can accumulate in a confined room, it needs to burn fuel as it operates and it cannot achieve a low enough temperature for certain applications.

Another prior art system uses liquid CO2 to freeze materials, which are then placed in an insulated container. This method results in a container that is able to maintain a temperature of −80° F., but is not self-contained and requires a separate freezing system.

What is needed is a low-tech container which has a very high insulation value, does not require an electrical connection, can keep product at a super low temperature, can keep foods either frozen or refrigerated or both at the same time in different compartments, for a long enough period of time to accomplish shipping, or to be useful in the field.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

These and other goals are accomplished in the container of the invention. The container is a generally rectangular, insulated box, with certain features which allow for far superior shipping, storage, freezing, and transport of frozen or refrigerated materials than found in the prior art. This is accomplished by a well-insulated box that includes an on-board refrigerant bunker, which is filled with a solid refrigerant, such as dry ice. The presence of the dry ice inside the insulated container results in the capability of freezing products in place and shipping them for a number of days in a frozen condition. If products are placed in the container already in a frozen state, they can stay in the shipping container for a longer period of time.

The invention is particularly well suited for shipping extremely perishable food long distances. For instance, for shipping sashimi, a stable temperature of −67° F. is needed to maintain flavor and texture. A standard refrigerated shipping container is not able to achieve this temperature level. A standard refrigerated unit can typically achieve −10° F. However, the shipping container of the invention can achieve a temperature of −100° F. This temperature can be maintained for at least five to seven days with one loading, and, if the refrigerant bunker is recharged, this temperature can be maintained indefinitely. Depending on the size of the container and the refrigerant bunker, 400 pounds of dry ice may be added to the unit to charge it. Dry ice has a temperature of −109.3° F. Two weeks is a reasonable time for pre-frozen product to last in the shipping container. However, the shipping container has enough ability to absorb heat that fresh material may be placed in the shipping container and frozen to a temperature of −80° F. or lower within the container itself.

The container of the invention is generally rectangular, and can be sized for whatever application that refrigerated or frozen storage or shipping is required. This can include containers that are generally the size of a picnic cooler, to containers that are the size of an oceanic shipping container. Intermediate sizes include sizes that are approximately the size of a home freezer, or can be adapted to fit in the bed of a pickup or in a utility trailer. They can also be built into a utility trailer, so that the utility trailer itself includes the container.

The container of the invention includes a container body which is made up of sidewalls and a topside and a bottom side, within which is defined a product compartment. The exterior of the container is covered by an outer skin for structural protection of the container from the environment around it. The outer skin can be made of metal, such as steel, stainless steel or aluminum. It can also be made of plastic or fiberglass. The inside of the container is lined with an inner skin. The inner skin can also be made of the metals listed above, as well as various kinds of plastics or resins or fiberglass. It's significant feature of the design of the container of the invention is that there is no thermal connection between the inner skin and the outer skin. If there is a need to connect the two, this is done by the use of a connection, which is not thermally conductive, such as nylon or plastic nuts and bolts, rivets, posts, or connectors of some kind. If the outer or inner skin is of a material that transmits heat, a thermal break is placed between their edges, on the sidewall in which the door or doors are located.

Between the outer skin and the inner skin is an insulation layer, which is present in order to prevent thermal transfer from the inner to the outer skin.

The container of the invention includes at least one access door that opens to allow product to be placed inside the container body. The access door is mounted on hinges, and closes with at least one latch. Included in the container is a refrigerant bunker for holding solid refrigerant. Since a solid refrigerant is usually dry ice, the solid phase of $CO^2$, a pressure release valve is present in the container body, which is a one-way valve that allows gas to exit the container body to relieve pressure inside the container. The door or doors of the container are sealed using a gasket, which is selected so that it does not freeze from condensation that may form around the door.

The refrigerant bunker may include one or more sides that are perforated in order to allow the permeation of gases. The bunker is preferably positioned near the top of the container body, and in different embodiments, may be positioned on the top center of the container body or at the top rear. If one door is present, the bunker is accessible from the front, and may be loaded with a ram.

One configuration of the device includes a base that is compatible with forklift handling, so that it may be moved easily and placed in shipping containers or trucks. The forklift base of the device may be designed so that it can be lifted from any of the four sides. The door latch of the invention is preferably lockable with a key and configured for accepting a padlock. The device would preferably include a thermometer that is visible on the outside of the container that displays the temperature on the inside of the container. A battery powered monitoring alarm system may be added, which alerts the user of critical internal temperature conditions. This optional system would have programmable alarms, with audible and/or visual signals.

One option for the container is to include an electrical heat trace embedded around the door in order to melt frost from around the door and to allow the door to be opened at its destination. The heat trace may be powered by an external power which is plugged into an electrical connection on a side wall of the container. The power for the heat trace may also be supplied by a battery built into the container. As well as having a powered electrical heat trace system, the non-freezing gasket of the shipping container can be silicone or Teflon gasket between the first door and the shipping container.

An optional feature of the container is a drain valve, for allowing liquid to drain from inside the container. Normally, there would be no frost formation in the container, and thus no possibility of the need to drain liquid. However, the drain valve can be supplied on some models if desired.

One embodiment of the invention includes a second access door for providing access to the refrigerant bunker. This allows refrigerant to be recharged without opening the main door and without the loss of refrigerant already inside the bunker. By placing the second access door on the topside wall, or high on one of the other side walls, the second access door can be opened with very little loss of cold air from inside the product compartment.

The product may optionally contain a slide out product tray, which is attached to the inside walls of the product compartment by rails. The slide out product tray is configured to be weight bearing when it is at its extended position. In that position the tray may be loaded and then moved into the product compartment.

A desirable feature of the container is to have all of the external features recessed into the outer skin so that nothing protrudes. In this way, any temperature control dials, thermometers, latches and hinges would be recessed so that the units could be stacked side by side without damage to a neighboring unit. The units are also configured for stacking. Multiple units may be stacked, depending on their configuration, loading and the space to be filled. The container may also include a loading ram to assist in filling the bunker with solid refrigerant. The loading ram may be configured to be stored inside the container, or it may also be configured to be attached to the outside of the container.

An optional feature of the container is an internal safety release, with which a person inside the container may open the access door from the inside. The internal safety release may include a light emitting feature, such as a florescent handle or sign, or an LED light which is powered by an on-board battery and may be configured to flash for a period of time after the door is closed.

The container may also include a self-contained liquid system capable of temperatures of −200° F. Other options include an active refrigeration and on-board active refrigeration component such as a battery powered liquid refrigerant metering system, a solar power refrigeration system, or a compressor based refrigeration system. These systems can act as auxiliary systems in order to initially freeze product, or to be activated when the dry refrigerant runs low.

One embodiment of the invention includes the bunker placed side by side with the product compartment with doors that are positioned side by side on the same wall of the container, which can be the front or the top and either side by side, or stacked one above the other. In this configuration the bunker can be thermally separated from the product compartment and can be configured to refrigerate, rather than freeze product in the product compartment. To accomplish this, a cooling means is provided to cool the product compartment utilizing the solid refrigerant in the bunker in the adjacent compartment. Another configuration is one in which there are two compartments provided, one for refrigerated product and one to house the bunker in a second compartment with enough space in the second compartment, adjacent to the bunker, to provide an area for frozen products. This unit would be able to ship a frozen product as well as a refrigerated product. The relative sizes of the first and second product compartments could be varied depending on the needs of a particular application.

A means for heat transfer from the refrigerated product into the bunker would be provided, such as a gas passage between the first and second product compartments, or use of the heat transfer bar as a conductive cooling element to remove heat from the refrigerated product. If a gas or air passage is utilized, an air passage cover can be provided, which would allow the amount of air passing through the air passage to be controlled by the user. This would control the temperature in the refrigerated portion of the container. The air passage cover could be a dish shaped device with various openings or louvers for air passage, which could be rotated to allow more or less air passage. A version of this could be adjusted from inside the unit such as a control in the first or second product compartment, or it could also be controlled by a temperature control dial located on the outside skin of the container. The placement of one or more thermometers in the container would facilitate this adjustment for temperature, and such thermometers would typically be recessed into the skin of the unit, could be placed in one or both of the compartments, and be visible in the doors, top or side walls of the compartment.

One configuration of the device would utilize a heat transfer bar that passes through a separation wall between the two units. The heat transfer bar could be fixed in place, or could be adjustable to increase or decrease heat transfer between the two compartments. In a unit that is adjustable, the heat transfer bar or bars would move through seal flanges in the separation wall, and could be adjustable from inside the container, or by a temperature control knob outside the container.

One configuration of the container of the invention is one in which the container is configured onto the framework of the utility trailer, forming a portable refrigeration unit on wheels, towable by a vehicle. This configuration of the container of the invention could serve as a freezer for a mobile kitchen, or in a disaster recovery operation, or as a field freezer for on on-the-farm butcher.

Another configuration would be an insulated container mounted on a frame forming part of the utility trailer, with part of the utility trailer being a container for freezing, storing and transporting frozen product, and another part of the utility trailer being available for other equipment as selected by the user. This could include ATV's, motorcycles, bicycles, camping equipment or other equipment. Such a configuration would be useful for hunters, who could load their ATV's and motorcycles onto a utility trailer, with part of the utility trailer being a freezing compartment into which game could be placed. Thus, a deer hunter or elk hunter could freeze or refrigerate his meat in the field and bring it to town. Similarly, a mobile butcher unit could have a freezing compartment of the invention built into a utility trailer or onto the bed of a pickup, and after killing and dressing the meat in a remote location, could place the meat in the container built into the utility trailer or truck bed, and freeze it on the way to other storage areas. This provides smaller companies an alternative to purchasing an expensive refrigerator truck.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
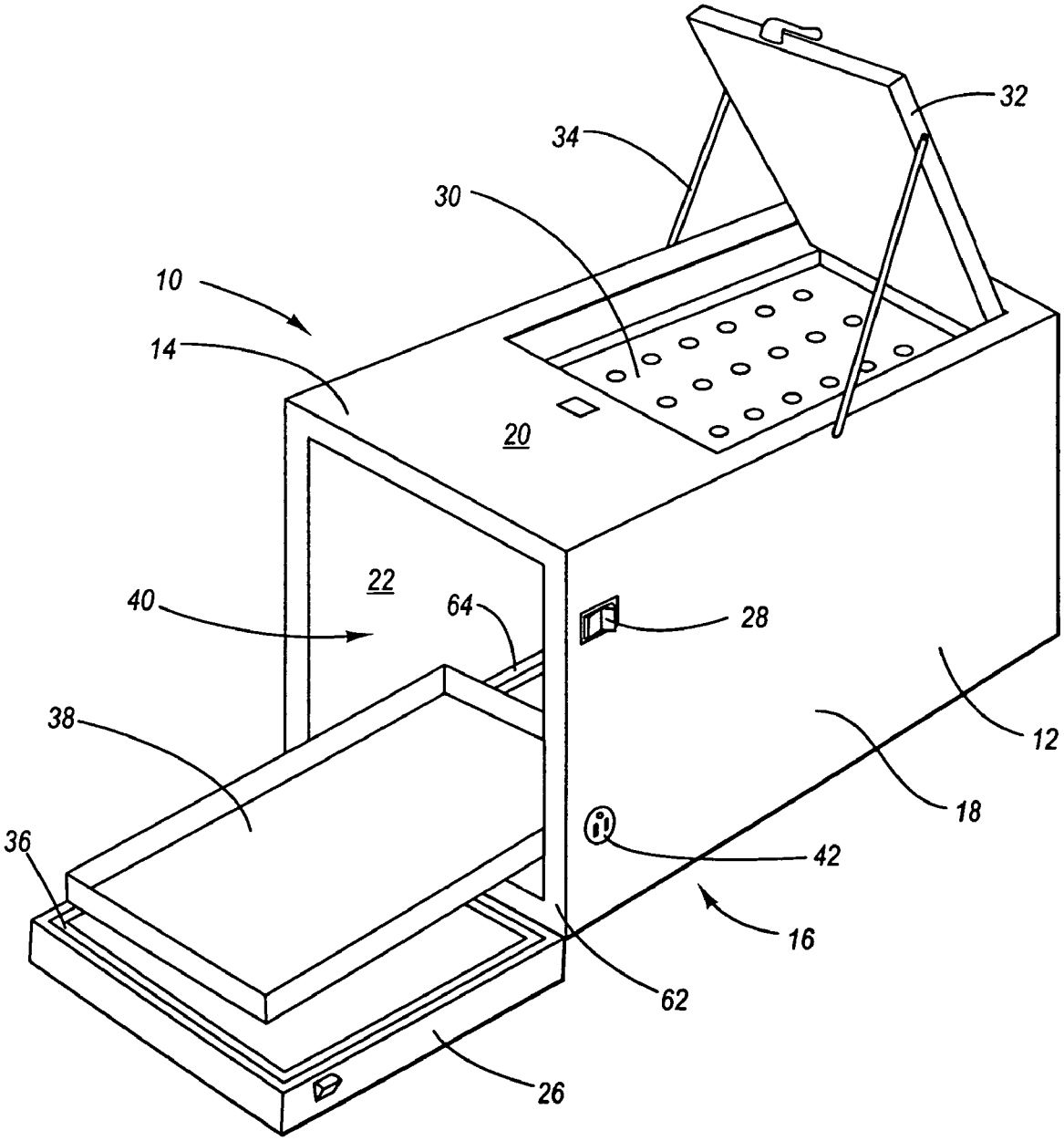
FIG. 1 is a perspective view of the container of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Some preferred embodiments are shown in FIGS. 1 through 12. FIG. 1 shows a container 10 of the invention. The container 10 includes a generally rectangular container body 12, which is made up of a top side 14, a bottom side 16 and side walls 18. The container 10 of the invention includes an outer skin 20 and inner skin 22. Between the inner skin 22 and the outer skin 20 is located an insulation layer, which is better shown in FIG. 3. It also includes an access door 26, which is secured by one or more latches 28. If the inner skin or outer skin is made of a material that is heat conductive, such as a metal, a heat break 62 of non-heat conducting material separates them and is situated under the gasket of the access door.

The container 10 includes a refrigerant bunker 30 which is located in the container body 12. The refrigerant bunker 30 is available for holding solid refrigerant, such as dry ice. The refrigerant bunker may be accessible through the access door 26, or it may have a second access door 32 available for accessing the refrigerant bunker 30.

FIG. 1 shows a second access door 32, with hold open devices 34, which can be a mechanical hold open or a telescoping strut. The preferred embodiment of the invention also includes a gasket 36, which is mounted on the access door 26, or could be mounted on the front face of the wall against in which the access door 26 seals. The preferred embodiment also includes a slide out tray 38 on rails 64, which is preferably designed so that it my be slid forward out of the product compartment 40, so that product may be loaded on the slide out tray 38, and then slid into the product compartment 40. The shipping container can also include a metal floor or skin. The metal floor or inner skin is thermally isolated from the outside of the shipping container so that heat does not enter the shipping container from any part of the metal floor being in thermal contact with the outside.

The container 10 of the invention can be made in various sizes, to suit the needs of the user. Examples can be containers the size of a picnic cooler, containers sized to fit in the back of a pickup, and containers for ocean freight shipment. For instance, the slide out tray 38 can be big enough to accommodate the contents of a picnic cooler size box, or the slide out tray 38 can be large enough to accommodate three to five men standing on the extended pallet, or large enough to place one or more fork lifted pallets onto the slide out tray 38 for insertion into the box, and shipment.

The container of the invention can be configured based on the freezing and shipping requirements of the job it is built for, but one preferred embodiment is a container, which is approximately 48 inches tall by 48 inches wide by 48 inches deep. A preferred thickness of the insulation layer for such a size is approximately 6 inches thick. The preferred method of making the insulation layer is for it to be molded in place from a liquid that solidifies into a solid foam, such as urethane or polyisocyanurate, extruded polystyrene, or other materials. Alternatively, solid blocks of foam such as Styrofoam can be cut to fit the interior of a container, with the interior skin placed inside the Styrofoam. The material or the interior and exterior skin can also vary depending on the application the container is to be used for. Certain applications will be best served by an exterior skin of metal, such as stainless steel or aluminum. Other applications are better served by an exterior skin of plastic or fiber reinforced plastic. Likewise, the interior skin can be stainless steel, aluminum, or various types of plastic.

A significant feature of the construction of the container 10 is that there is no thermally conducting connection between the exterior skin and interior skin. Were connections need to be made, they can be done so by the use of plastic or nylon nuts and bolts, or by the use of adhesive, or other materials that do not provide a thermal conduit from the outside to the inside.

Latches can take a number of different forms, but a preferred embodiment is to use draw latches to latch the access door 26, and draw-type latches to latch the second access door 32. Other latch options include cam latches, single pressure latches, multiple cam latches, draw latches, and others. A refrigerator egress door is provided on large models, so a person can get out if trapped inside.

The shipping container is preferably rectangular, and every feature of the shipping container can be recessed so that they may be stacked closely together and with no protrusions from one container to damage the exterior of a neighboring container.

The preferred gasket material to use around the doors is a low temperature silicon gasket, which is proven to be freeze resistant. Alternatively, a low temperature Teflon gasket may also be used, and other gasket materials are possible, if they meet the requirement that they not cause the door to freeze shut.

An optional feature is to include a heat tracing feature around the access door 26. The heat tracing would be activated by providing external power to the container 10 at an electrical connection 42. Providing power at the electrical connection would activate heat tracing located around the access door 26. The heat tracing would melt any build up of ice and free the door. Heat tracing and an external power connection is an optional feature of the container 10. The preferred form of this electrical connection is for it to be a male electrical connection, which is mounted in a recess so that the electrodes of the connection do not protrude from the recess. With the male connection, a standard extension cord may be utilized to connect power to the shipping container. The power source can also be a battery, which can be attached to electrodes on the exterior of the shipping container or can be built into a compartment on the shipping container.

Figure 2:
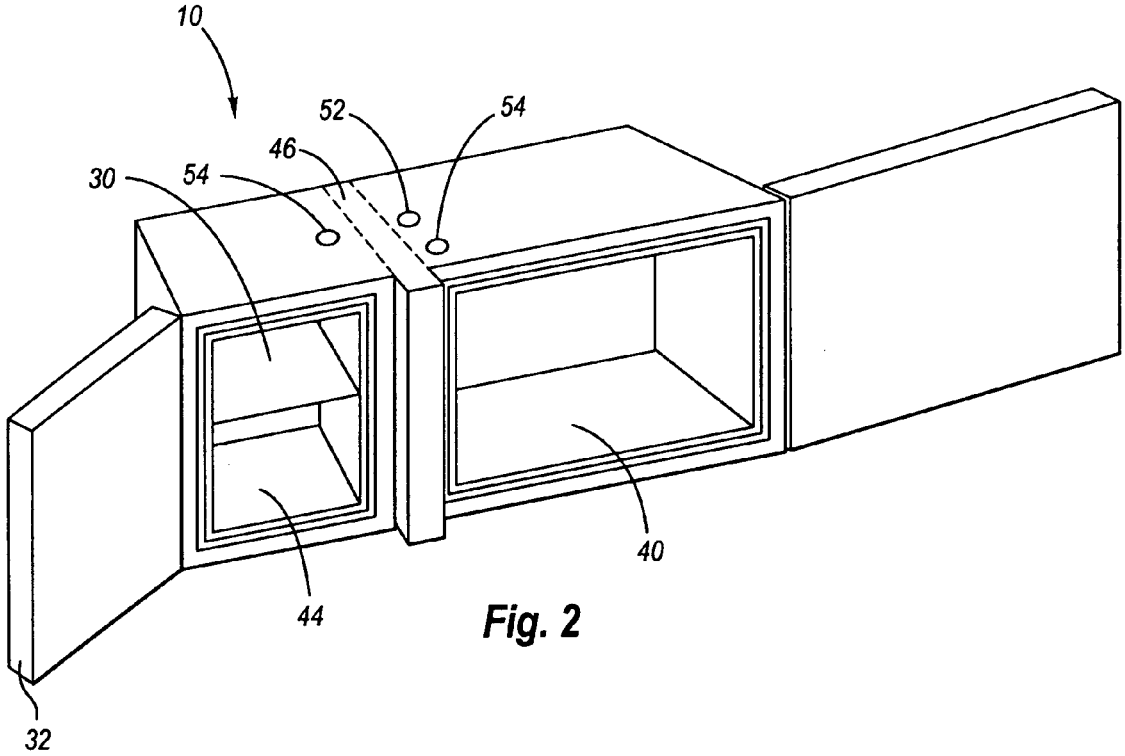
FIG. 2 is a perspective view of one embodiment of the invention.
Figure 3:
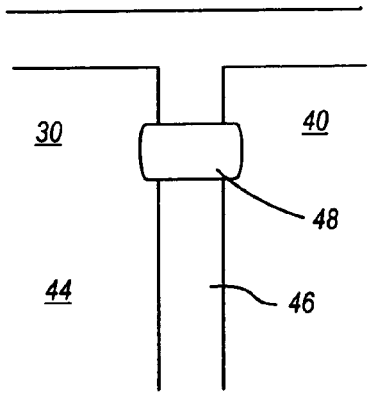
FIG. 3 is a side cross-section view of a portion of the container.
Figure 4:
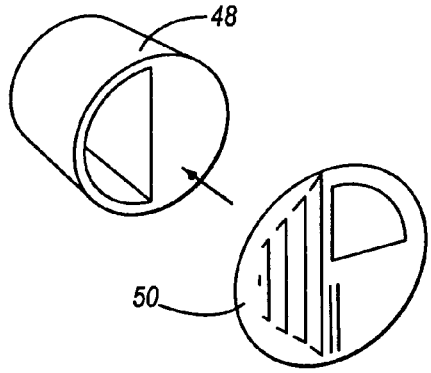
FIG. 4 is an exploded view of the air passage.

FIG. 2 is another embodiment of the container 10. It includes a first product compartment 40 and a second product compartment 44. Shown is a refrigerant bunker 30, located in the second product compartment 44. This embodiment includes an access door 26, and a second access door 32. This configuration is designed so that the second product compartment 44 serves to freeze product and/or to ship it in a frozen state, or may be completely occupied by the refrigerant bunker. The first product compartment 40 is separated from the second product compartment 44 by a separation wall 46. A heat transfer means is provided to transfer heat from the first product compartment 40 to the refrigerant in the refrigerant bunker 30. This heat transfer means can be in the form of an air passage 48 as shown in FIG. 3. The air passage 48 allows a transfer of air from the first product compartment 40 to the second product compartment 44, at a rate so that a controlled temperature is reached in the first product compartment 40. With this device, refrigerated goods could be shipped and stored in first product compartment 40 while frozen goods are shipped and stored in second product compartment 44. The air passage 48 can be regulated by use of an air passage cover 50. This can be a rotating plate in which are defined various shapes of perforations or holes. By rotating the air passage cover 50, less or more air transfer is allowed, thus regulating the temperature in the first product compartment 40. Designs are possible with more than one air passage 48, and with different diameters of air passage 48. The preferred embodiments include an air passage 48 in which the air passage cover 50 is manually set at a position to yield a desired temperature in the first product compartment 40. Another preferred embodiment is one in which the air passage cover 50 can be adjusted externally through a temperature control dial 52. To facilitate temperature control and verification, one or more thermometers 54 can be utilized with the container of the invention. These are shown in FIG. 2 as being located on the top wall, but depending on the application, may also be positioned on the doors, or one of the side walls, or the back side. FIG. 4 shows an exploded view of the air passage 48 and the air passage cover 50.

Figure 5:
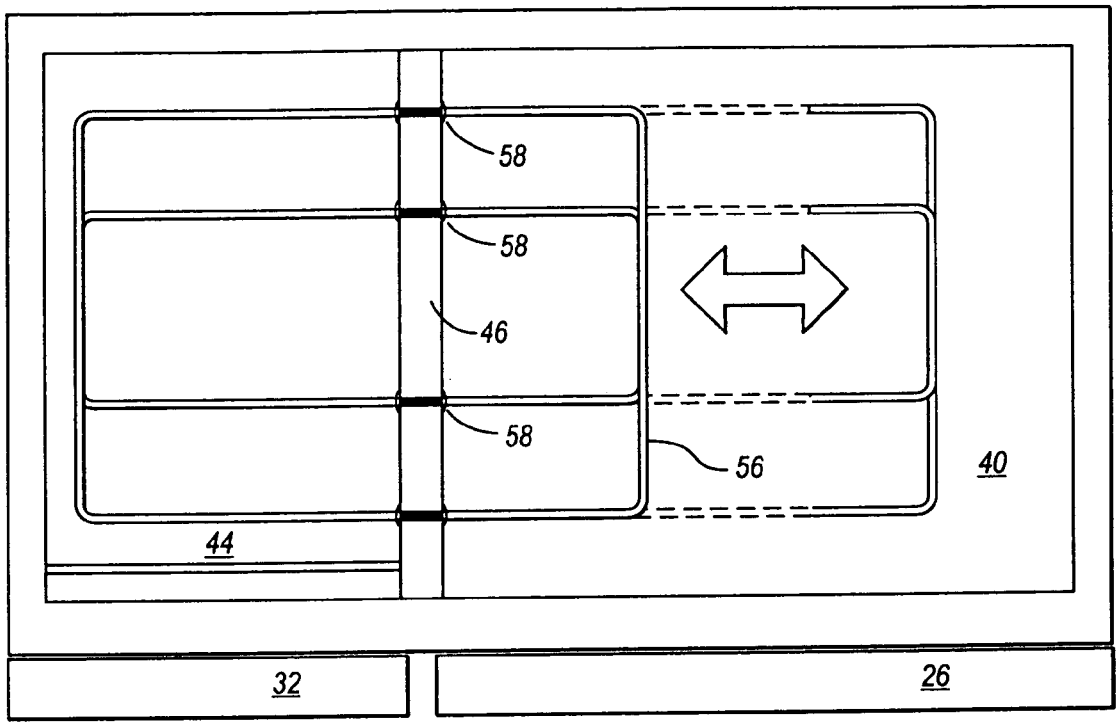
FIG. 5 is a top cut-a-way view of one embodiment of the invention.
Figure 6:
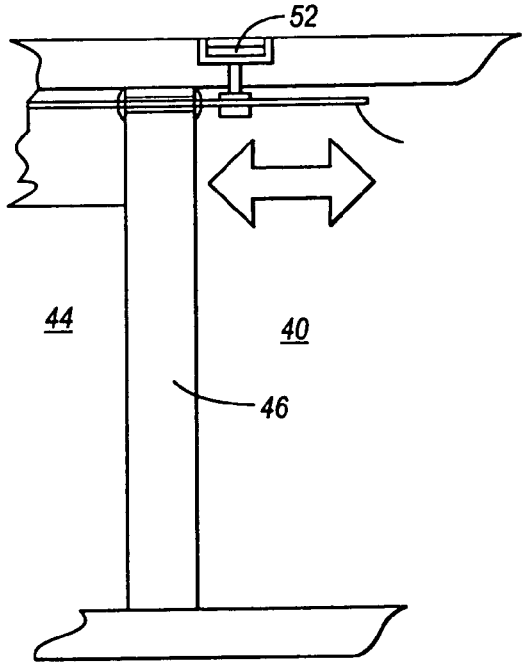
FIG. 6 is a front cross-section view of a part of one embodiment of the invention.

An alternative heat transfer means between the first product compartment 40 and the second product compartment 44, is a heat transfer bar 56. One embodiment of the heat transfer bar 56 is shown in FIG. 5, and is a grid of bars which passes through the separation wall 46 and may be moved to expose more or less material in the first product compartment 40 or the second product compartment 44. By moving the heat transfer bar 56 from left to right in the view shown in FIG. 5, more of the heat transfer bar is exposed to the air in first product compartment 40, and thus may pick up heat and transfer it to the cold area adjacent to the heat transfer bar 56 in the refrigerant bunker 30, located in the second product compartment 44. The heat transfer bar 56 passes through one or more seal flanges 58. The seal flanges 58 provide a block for air passage between the two compartments and yet allows the heat transfer bar 56 to slide back and forth between them. One preferred embodiment of the invention of this configuration is a heat transfer bar 56, which is manually adjusted to achieve the desired temperature. Another preferred embodiment is one in which the heat transfer bar 56 may be adjusted externally with a temperature control dial 52 as shown in FIG. 6. The temperature control dial 52 interacts with the heat transfer bar 56 by any number of configurations to allow the heat transfer bar 56 to be moved in and out of the first product compartment 40.

Figure 7:
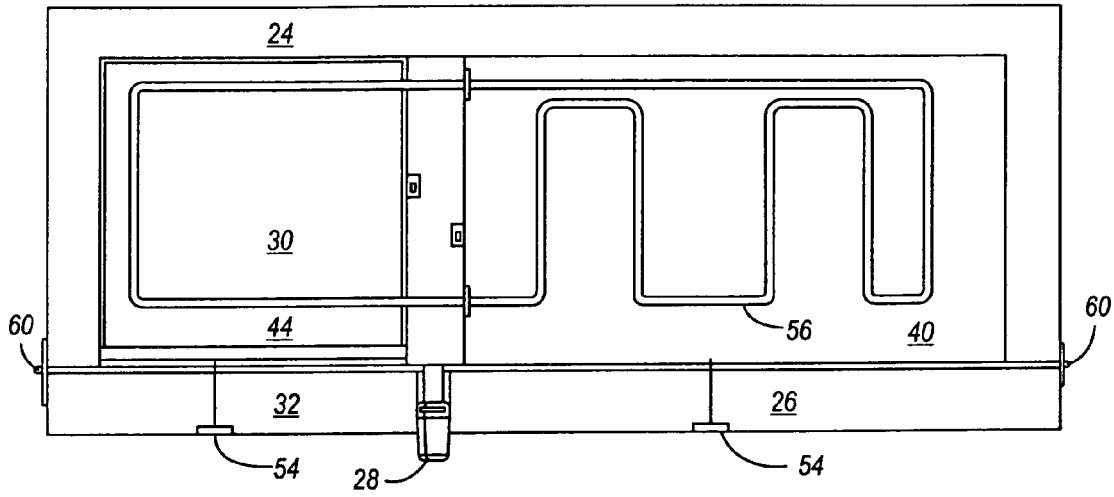
FIG. 7 is a top cross-section view of one embodiment of the invention.
Figure 8:
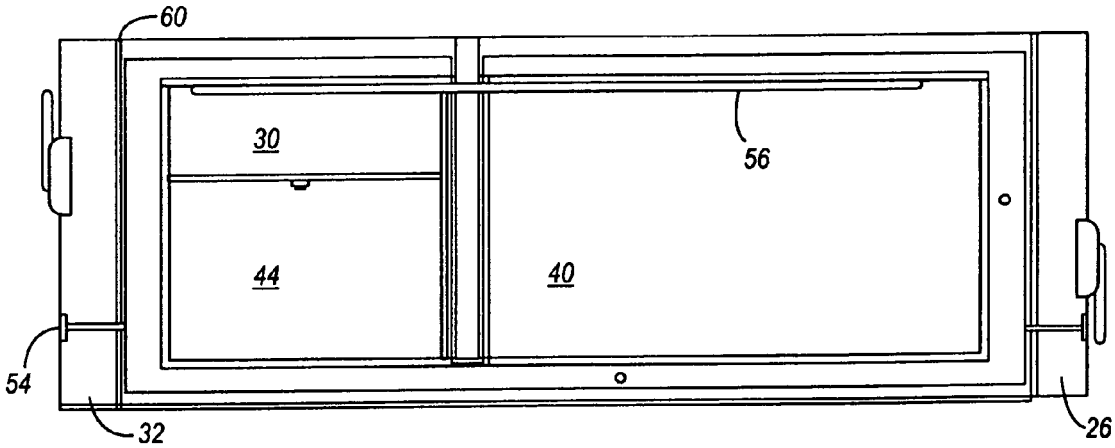
FIG. 8 is a front view of one embodiment of the invention.

FIG. 7 and FIG. 8 show an alternative method of maintaining two separate temperatures in the two compartments of the container. FIG. 78 shows a heat transfer bar 56 that is permanently positioned in the first product compartment 40. It extends into the second product compartment 44, and is adjacent to the refrigerant bunker 30. FIG. 8 is a view of the same embodiment as shown in FIG. 7, showing a view of the front of the container with the doors open. The doors are attached by hinges 60, obviously a number of different configurations of the heat transfer bar 56 are possible, and it may be constructed of a solid metal piece, or may be tubular or rod shaped in cross section.

Figure 9:
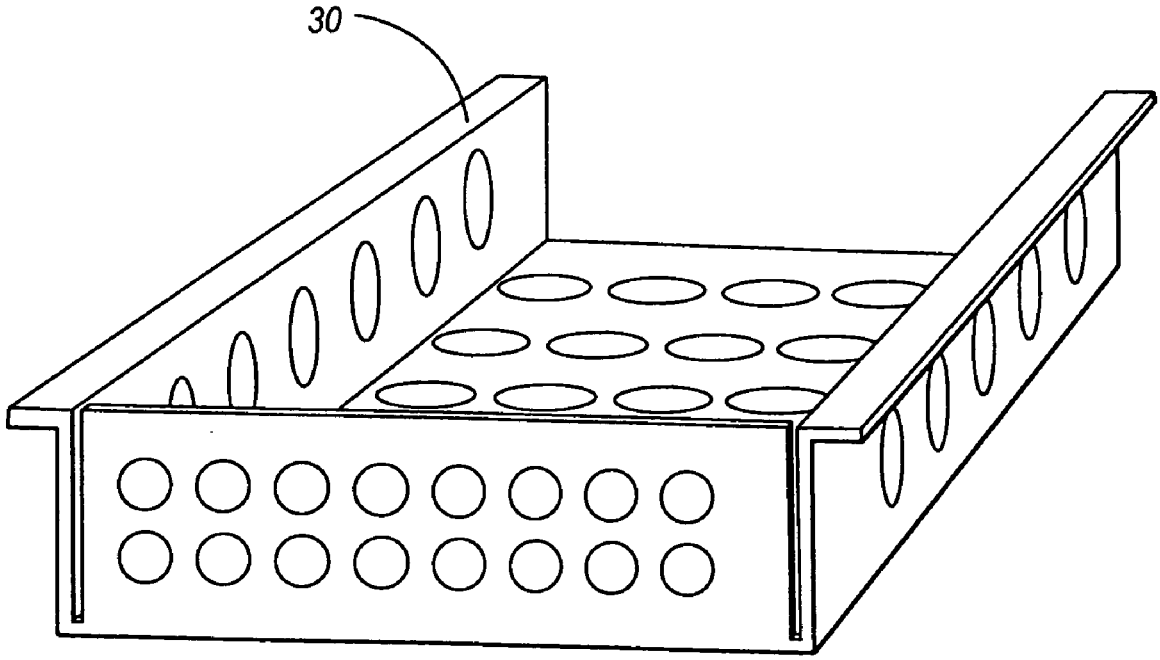
FIG. 9 is a perspective view of the bunker of the invention.

FIG. 9 shows a bunker of the invention, which is preferably made of perforated aluminum, and is mounted close to the top of the container body.

The shipping container can also be fitted with an active refrigeration unit so that the user may choose between active and passive refrigeration. Alternative refrigeration systems can also be fitted into the container of the invention, such as metered liquid refrigeration, gasoline or electric powered, or solar powered refrigeration units.

Figure 10:
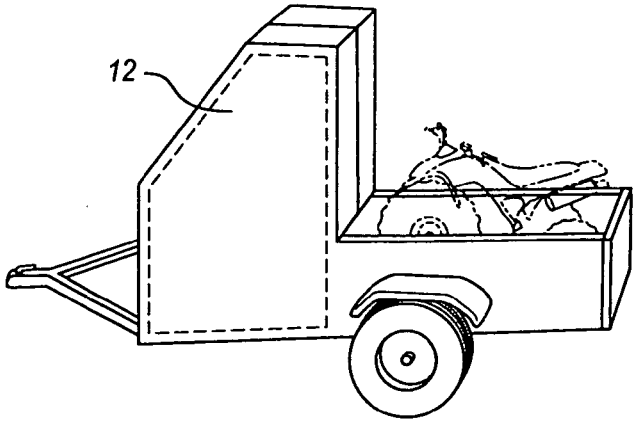
FIG. 10 is a perspective view of the invention as an ATV carrier.
Figure 11:
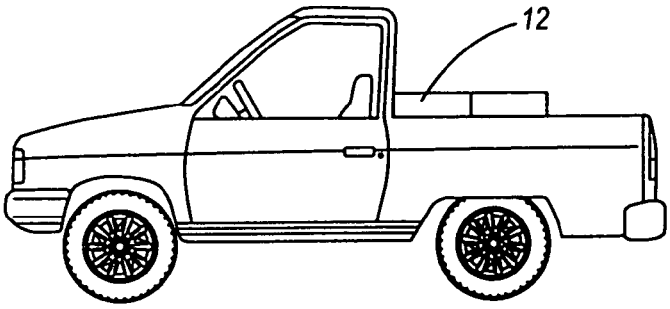
FIG. 11 is a perspective view of the invention as a pickup insert.
Figure 12:
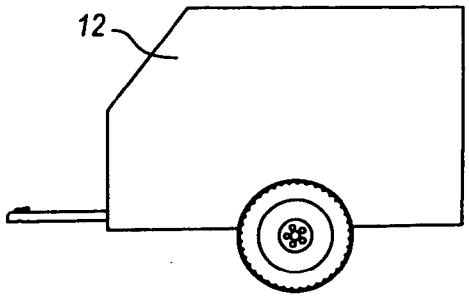
FIG. 12 is a perspective view of the invention as a utility trailer.

FIGS. 10, 11 and 12 show other embodiments of the invention, with the container body 12 built into an ATV carrier (FIG. 10), as a pickup insert (FIG. 11) and built into a utility trailer (FIG. 12).

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A container for frozen shipping of products at extreme subzero temperatures, comprising:

a generally rectangular container body, sidewalls, top and bottom, and defining a product compartment;

an outer skin, covering said sidewalls and said top and bottom sides, for structural protection of said container from the environment;

an inner skin, for isolating and protecting the container from the product being shipped, with said inner skin secured within said container without any thermally conductive connection with said outer skin;

an insulation layer between said outer skin and said outer skin, for preventing heat transfer between said product compartment and said outer skin;

at least one access door in said container body for placement and removal of said product said container body, and for access to a bunker;

a second door with access to said refrigerant bunker to allow refrigerant to be recharged without the loss of refrigerant already inside said bunker;

at least one latch for securing said access door in a closed position;

a refrigerant bunker in the container body, for holding solid refrigerant;

a pressure release valve in said container body, for relieving pressure buildup inside said container body; and a non freezing gasket between said container body and said first door, so that said first door may be opened and is not frozen to said container body; wherein said bunker is configured to be loaded with a solid refrigerant, and said product compartment is configured for placement of a product to be frozen or which is already frozen through said access door, with said access door sealable with said latch for transport of product in a frozen state.

2. The container of claim 1, which further includes a forklift compatible base attached to the container body, to facilitate forklift movement of said shipping container.

3. The container of claim 1 in which said bunker comprises at least one side permeable to gasses.

4. The shipping container of claim 1 in which said bunker is positioned in the center of said top on the inside of said container body.

5. The shipping container of claim 1 in which said non-freezing gasket further comprises electrical heat trace conductors to keep said first door from being frozen shut, and a power source.

6. The shipping container of claim 5 in which said power source is an electrical connection through which external power is supplied to the shipping container.

7. The shipping container of claim 5 in which said power source is a battery.

8. The shipping container of claim 1 which further includes a drain valve, for removing liquid from the interior of the shipping container.

9. A container for frozen shipping of products at extreme subzero temperatures, comprising:

a generally rectangular container body, sidewalls, top and bottom, and defining a product compartment;

an outer skin, covering said sidewalls and said top and bottom sides, for structural protection of said container from the environment;

an inner skin, for isolating and protecting the container from the product being shipped, with said inner skin secured within said container without any thermally conductive connection with said outer skin;

an insulation layer between said outer skin and said outer skin, for preventing heat transfer between said product compartment and said outer skin;

a first access door in said container body for placement and removal of said product in said container body;

at least one latch for securing said access door in a closed position;

a refrigerant bunker in the container body, for holding solid refrigerant;

a second access door for providing access to said bunker in said container body;

at least one latch for said second access door;

a pressure release valve in said container body, for relieving pressure buildup inside said container body; and a non freezing gasket between said container body and said first door, so that said first door may be opened and is not frozen to said container body; wherein said bunker is configured to be loaded with a solid refrigerant through said second access door, with second access door sealable with said latch, with said product compartment configured to be access through said first access door, with said product compartment is configured for placement of a product to be frozen or which is already frozen through said access door, with said access door sealable with said latch for transport of product in a frozen state.

10. The container of claim 1 in which said second access door is positioned in said top wall of said container body.

11. The container of claim 1 in which said second access door is positioned at the rear of said container, in the top wall of said container body.

12. The container of claim 1 which further includes a slide out product tray, which is configured for supporting the weight of said product when said tray is extended, and which is configured to slide into said product compartment for sealing and transport.

13. A container for frozen shipping of products at extreme subzero temperatures, comprising:

a generally rectangular container body, sidewalls, top and bottom, and defining a product compartment;

an outer skin, covering said sidewalls and said top and bottom sides, for structural protection of said container from the environment;

an inner skin, for isolating and protecting the container from the product being shipped, with said inner skin secured within said container without any thermally conductive connection with said outer skin;

an insulation layer between said outer skin and said outer skin, for preventing heat transfer between said product compartment and said outer skin;

a first access door in said container body for placement and removal of said product in said container body;

at least one latch for securing said access door in a closed position;

a refrigerant bunker in the container body, for holding solid refrigerant;

a second access door for providing access to said bunker in said container body;

at least one latch for said second access door;

a pressure release valve in said container body, for relieving pressure buildup inside said container body; and a non freezing gasket between said container body and said first door, so that said first door may be opened and is not frozen to said container body;

a slide out product tray, which is configured for supporting the weight of said product when said tray is extended, and which is configured to slide into said product compartment for sealing and transport; wherein said bunker is configured to be loaded with a solid refrigerant through said second access door, with second access door sealable with said latch, with said product compartment configured to be access through said first access door, with said product compartment is configured for placement of a product to be frozen or which is already frozen through said access door, with said access door sealable with said latch for transport of product in a frozen state.

14. The container of claim 1 which is configured to have no parts protruding beyond the surface of said outer skin, in order to facilitate handling, storing, and shipping said container.

15. The shipping container of claim 1 in which at least one side of said bunker contains perforations, to aid in even heat distribution.

16. The shipping container of claim 1 which further includes a loading ram, which fits inside said bunker, and which is stored in said container, for use by the user to load refrigerant without coming into contact with said refrigerant.

17. The shipping container of claim 1 which further includes an internal safety release for opening said first door, accessible from within said shipping container.

18. The shipping container of claim 1 which further includes a metal interior lining which is thermally isolated from the outside of the shipping container.

19. The shipping container of claim 1 which further includes an active on-board refrigeration unit.

20. The shipping container of claim 1 which further includes an on-board and self contained liquid spray refrigeration system.

21. The shipping container of claim 1 which further includes a solar powered refrigeration system.

22. The container of claim 1 in which said first door and said second door are positioned side by side on a front side of said container.

23. The container of claim 1 which further includes a first product compartment for refrigerated product, and a second product compartment for frozen product, with a separation wall between the first and second product compartments, with said bunker located in said second product compartment, and cooling means provided to cool but not freeze product in said first product compartment.

24. The container of claim 23 in which the cooling means is a gas passage between the first and second product compartments.

25. The container of claim 24 in which said gas passage is adjustable to control the temperature in the first product compartment.

26. The container of claim 25 in which said gas passage is adjustable from outside the container.

27. The container of claim 23 in which the cooling means is a cooling element that extends from the second to the first product compartment, and transfers heat by conduction through the cooling element.

28. The container of claim 27 in which said cooling element is adjustable to control the amount of heat transfer, and thus the temperature in the first product compartment.

29. The container of claim 25 in which said cooling element is adjustable from outside the container.

30. The container of claim 23 in which said first door and said second door are positioned side by side on a front side of said container.

31. The container of claim 1 which is incorporated into a utility trailer, at least two wheels and a frame, and towing structure.

32. The container of claim 31 in which the utility trailer includes space for equipment such one of more ATVs and/or motorcycles.

33. The container of claim 1 which is configured for mounting in a vehicle as a cargo box.

* * * * *